US008079331B2

(12) United States Patent
Vattaneo et al.

(10) Patent No.: US 8,079,331 B2
(45) Date of Patent: Dec. 20, 2011

(54) INTERNAL-COMBUSTION ENGINE, IN PARTICULAR A TWO-CYLINDER ENGINE, PROVIDED WITH A SIMPLIFIED SYSTEM FOR VARIABLE ACTUATION OF THE ENGINE VALVES

(75) Inventors: Francesco Vattaneo, Orbassano (IT); Laura Gianolio, Orbassano (IT)

(73) Assignee: C.R.F. Societa Consortile per Azioni, Orbassano (Torino) (IT)

( * ) Notice: Subject to any disclaimer, the term of this patent is extended or adjusted under 35 U.S.C. 154(b) by 332 days.

(21) Appl. No.: 12/434,922

(22) Filed: May 4, 2009

(65) Prior Publication Data

US 2009/0320776 A1 Dec. 31, 2009

(30) Foreign Application Priority Data

Jun. 25, 2008 (EP) ..... 08425451

(51) Int. Cl.
*F01L 9/02* (2006.01)

(52) U.S. Cl. ..... 123/90.12; 123/90.16

(58) Field of Classification Search ..... 123/90.12, 123/90.15, 90.16, 90.48
See application file for complete search history.

(56) References Cited

U.S. PATENT DOCUMENTS

| | | | |
|---|---|---|---|
| 4,615,306 | A | 10/1986 | Wakeman |
| 5,503,120 | A | 4/1996 | Shirey et al. |

FOREIGN PATENT DOCUMENTS

| | | |
|---|---|---|
| DE | 36 04 233 | 8/1987 |
| DE | 42 06 696 | 9/1993 |
| EP | 1 243 761 | 9/2002 |
| EP | 1 555 398 | 7/2006 |

OTHER PUBLICATIONS

European Search Report EP 08425451.5 dated Feb. 11, 2009.

*Primary Examiner* — Zelalem Eshete
(74) *Attorney, Agent, or Firm* — Nixon & Vanderhye P.C.

(57) ABSTRACT

An internal-combustion engine provided with a simplified system for variable actuation of the valves, which envisages for two different engine cylinders a single solenoid valve that controls connection to an exhaust channel of two pressurized chambers associated to the intake valves of the two different cylinders.

1 Claim, 5 Drawing Sheets

INTERNAL-COMBUSTION ENGINE, IN PARTICULAR A TWO-CYLINDER ENGINE, PROVIDED WITH A SIMPLIFIED SYSTEM FOR VARIABLE ACTUATION OF THE ENGINE VALVES

SUMMARY OF THE INVENTION

The present invention relates to multi-cylinder internal-combustion engines, particularly for motor vehicles, of the type comprising:

at least one intake valve and at least one exhaust valve for each cylinder, each provided with respective elastic return means that push the valve towards a closed position, for controlling the respective intake and exhaust pipes;

at least one camshaft, for actuating the intake valves and exhaust valves of the engine cylinders by means of respective tappets;

wherein each intake valve is controlled by the respective tappet, against the action of the aforesaid elastic return means, by interposition of hydraulic means including a pressurized-fluid chamber;

said pressurized-fluid chamber being designed to be connected by means of a solenoid valve to an exhaust channel in order to uncouple the intake valve of the respective tappet and cause fast closing of the valve as a result of the respective elastic return means; and electronic control means for controlling each solenoid valve in such a way as to vary the time and stroke of opening of the respective intake valve as a function of one or more operating parameters of the engine.

Internal-combustion engines of the type indicated above are described and illustrated in a wide range of patents filed in the name of the present applicant, amongst which, for example, EP 1 555 398 B1. The system with which said engines are equipped is able to actuate the engine intake valves in a variable way, by varying in particular the opening and closing instants and the lift thereof, as a function of the operating conditions of the engine, so as to optimize the efficiency of the engine and/or reduce the fuel consumption and/or reduce the noxious exhaust emissions and/or obtain particular operating modalities of the engine, such as, for example, an engine-brake modality.

The object of the present invention is to improve the aforesaid system by proposing a version thereof that is substantially simplified as compared to the known embodiments.

With a view to achieving the above purpose, the subject of the invention is an engine of the type indicated at the start of the present description, characterized in that:

said engine has at least two different cylinders that have their respective intake strokes out of phase with respect to one another substantially by one complete revolution of the engine shaft; and the aforesaid communication with the exhaust channel of the pressurized-fluid chambers associated to the intake valves of said two different engine cylinders is controlled by a single common solenoid valve.

The idea underlying the present invention consequently consists in controlling by means of a single solenoid valve variable actuation of the intake valves of two (or more) different engine cylinders, exploiting the fact that in the engine according to the invention the intake strokes of the two different cylinders are sufficiently distant to enable use of one and the same solenoid valve for controlling the intake valves of both of the cylinders. One and the same solenoid valve consequently controls in a pre-set way opening and closing of both the intake valve (or valves) of a first cylinder of the engine, when this is in its intake stroke, and the intake valve (or valves) of a second cylinder of the engine, when this is in its intake stroke. The typical case of engine to which the invention is particularly aimed is that of a compact two-cylinder engine for a motor vehicle of small dimensions, in which the two cranks of the crankshaft associated to the two pistons of the engine are out of phase with respect to one another by 0° (or, what amounts to the same thing, by 360°) so that the two pistons associated to said cylinders reach the Top Dead Centre (TDC) and the Bottom Dead Centre (BDC) simultaneously in the various steps of operation of the engine. In an engine of this type, the intake strokes of the two cylinders are out of phase with respect to one another by one complete revolution of the engine shaft.

In the preferred embodiment of the invention, the engine is of the type, in itself known (see, for example, EP 1 555 398 B1), provided in which is a main channel for supply of fluid under pressure communicating with the pressurized chambers, which are associated to the intake valves of the various cylinders via respective first non-return valves, which enable the passage of fluid only in the direction of the pressurized-fluid chambers. In the case of said specific embodiment, the invention is moreover characterized in that the pressurized chambers, which are associated to the intake valves of the two aforesaid different engine cylinders are also directly connected to one another by a by-pass channel, via two respective second non-return valves that enable the passage of fluid only from each of the two pressurized chambers towards said by-pass channel, said by-pass channel being designed to be set in communication via the aforesaid single common solenoid valve with a common exhaust channel for the two pressurized chambers, which are associated to the intake valves of the two cylinders.

According to a further preferred characteristic, associated to the two aforesaid pressurized chambers, which are associated to the intake valves of said two different engine cylinders, is a single common fluid accumulator, which is in communication with said common exhaust channel.

Once again in the case of the aforesaid preferred embodiment, in the main channel (50) for supply of pressurized fluid there is preferably interposed, in a way in itself known (see EP 1 555 398 B1), at least one fluid tank (40), vented at the top to the atmosphere, having an inlet (40*a*) at its top for receiving the pressurized fluid and an outlet (40*b*) on its bottom connected to the pressurized chambers (C) via said first non-return valves (V1), which is designed to perform a siphon function for purging the air present in the fluid. In this case, the engine according to the invention is moreover characterized in that said tank has a further outlet on its bottom communicating with said common exhaust channel.

Thanks to the characteristics indicated above, the engine according to the invention enables a substantial simplification and reduction of components as compared to the engines of the known type referred to at the start of the present description. In particular, the system of variable actuation of the intake valves associated to the various engine cylinders enables a substantial reduction (specifically halving) of the number of solenoid valves designed for control, as well as a reduction (typically halving) of the number of fluid accumulators associated to the pressurized chambers for actuation of the valves of the various cylinders. A further reduction regards also the number of fluid tanks with which the system is provided.

On account of its arrangement, the system according to the invention guarantees a better cold filling of the pressurized-fluid chambers thanks to the pre-arrangement of the aforesaid non-return valves that enable a larger area of passage as compared to that of the solenoid valves used in the known solutions. The reduction of the components leads also to a smaller encumbrance of the entire system, a simplification of the controls that must be pre-arranged in the electronic control unit, and a simplification of the wiring of the solenoid valves.

All the aforesaid advantages render possible the use of the invention with particular advantageous effects on a compact two-cylinder engine, for a motor vehicle of small dimensions.

BRIEF DESCRIPTION OF THE DRAWINGS

Further characteristics and advantages of the invention will emerge from the ensuing description with reference to the annexed drawings, which are provided purely by way of non-limiting example and in which.

DETAILED DESCRIPTION OF THE INVENTION

Figure 1:
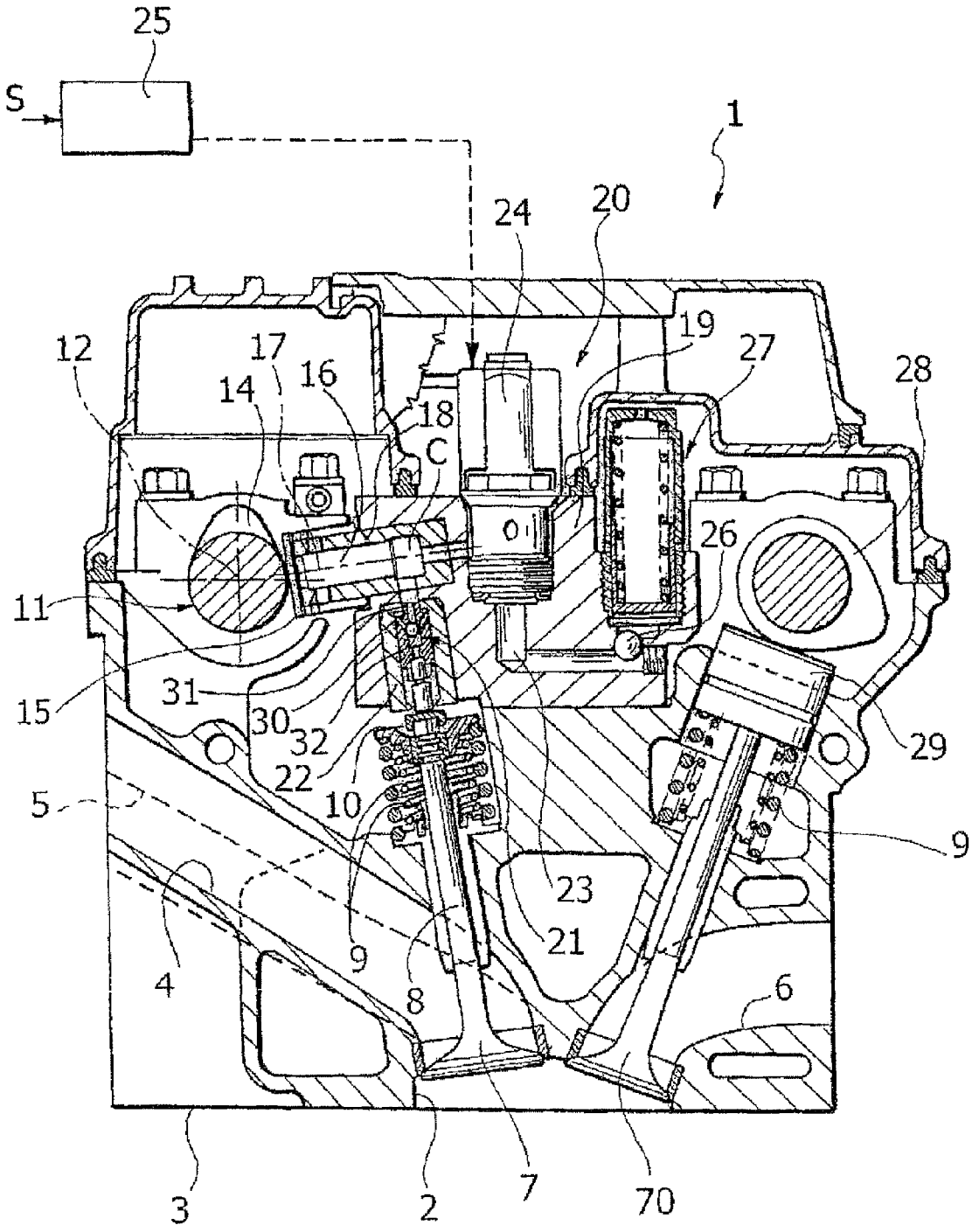
FIG. 1 is a cross-sectional view of an engine according to the known art, of the type described for example in EP 1 555 398 B1 filed in the name of the present applicant, where said engine is presented as known in turn from EP 0 803 642 B1, likewise filed in the name of the present applicant.

FIG. 1 of the present document coincides with FIG. 1 of the European patent EP 0 803 642 B1 filed in the name of the present applicant. It illustrates a multi-cylinder engine, for example, an engine with four cylinders in line, comprising a cylinder head 1. The cylinder head 1 comprises, for each cylinder, a cavity 2 formed by the base surface 3 of the cylinder head 1, defining the combustion chamber, giving out into which are two intake pipes 4, 5 and two exhaust pipes 6. Communication of the two intake pipes 4, 5 with the combustion chamber 2 is controlled by two intake valves 7, of the traditional mushroom type, each comprising a stem 8 mounted slidable in the body of the cylinder head 1. Each valve 7 is recalled towards the position of closing by springs 9 set between an internal surface of the cylinder head 1 and an end cup 10 of the valve. Communication of the two exhaust pipes 6 with the combustion chamber is controlled by two valves 70, which are also of a traditional type, associated to which are springs 9 for return towards the closed position. Opening of each intake valve 7 is controlled, in the way that will be described in what follows, by a camshaft 11 mounted so that it can rotate about an axis 12 within supports of the cylinder head 1, and comprising a plurality of cams 14 for actuation of the intake valves 7.

Each cam 14 co-operates with the cap 15 of a tappet 16 slidably mounted along an axis 17, which, in the case of the example illustrated in the prior document cited, is directed substantially at 90° with respect to the axis of the valve 7. The cap 15 is recalled against the cam 14 by a spring associated thereto. The tappet 16 constitutes a pumping piston mounted slidable within a bushing 18 carried by a body 19 of a pre-assembly 20, which incorporates all the electrical and hydraulic devices associated to actuation of the intake valves. The pumping piston 16 is able to transmit a thrust to the stem 8 of the valve 7 so as to cause opening of the latter against the action of the elastic means 9, by means of pressurized fluid (typically oil coming from the circuit for lubrication of the engine) present in a pressure chamber C which the pumping piston 16 faces, and by means of a piston 21 mounted slidable in a cylindrical body constituted by a bushing 22 that is also carried by the body 19 of the subassembly 20. Once again in the known solution illustrated in FIG. 1, the pressurized-fluid chamber C associated to the intake valve (or valves) 7 of each cylinder can be set in communication with an exhaust channel 23 via a solenoid valve 24. The solenoid valve 24, which can be of any known type suitable for the function illustrated herein, is controlled by electronic control means, designated schematically by 25, as a function of signals S indicating parameters of operation of the engine, such as the position of the accelerator and the number of turns of the engine. In the specific case illustrated, the solenoid valve is of a normally open type, designed to close following upon a supply of its solenoid. When the solenoid valve 24 is opened, the chamber C enters into communication with the channel 23 so that the pressurized fluid present in the chamber C flows in said channel, and an uncoupling is obtained of the cam 14 and of the respective tappet 16 from the intake valve 7, which hence rapidly returns into its closing position under the action of the return springs 9. By controlling the communication between the chamber C and the exhaust channel 23, it is consequently possible to vary the time and stroke of opening of each intake valve 7 as required.

The exhaust channels 23 of the various solenoid valves 24 all give out into one and the same longitudinal channel 26, which communicates with pressure accumulators 27, only one of which is visible in FIG. 1.

All the tappets 16 with the associated bushing 18, the pistons 21 with the associated bushing 22, the solenoid valves 24 and the corresponding channels 23, 26 are carried by and made out of the aforesaid body 19 of the pre-assembly 20 to the advantage of rapidity and ease of assembly of the engine.

The exhaust valves 70 associated to each cylinder are controlled, in the embodiment illustrated in FIG. 1, in a traditional way, by a respective camshaft 28, via respective tappets 29, even though in principle there is not ruled out, in the case of the prior document cited, an application of the hydraulic-actuation system also to control of the exhaust valve.

Once again with reference to FIG. 1, the variable-volume chamber defined within the bushing 22 faces the piston 21 (in FIG. 1 said chamber is illustrated in its condition of minimum volume given that the piston 21 is in its top end-of-travel position) and communicates with the pressurized-fluid chamber C via an opening 30 made in an end wall of the bushing 22. Said opening 30 is engaged by an end nose 31 of the piston 21 in such a way as to provide a hydraulic braking of the movement of the valve 7 in the closing stage, when the valve is close to the closing position, in so far as the oil present in the variable-volume chamber is forced to flow into the pressurized-fluid chamber C passing through the clearance between the end nose 31 and the wall of the opening 30 engaged thereby. In addition to the communication constituted by the opening 30, the pressurized-fluid chamber C and the variable-volume chamber of the piston 21 communicate with one another via internal passages made in the body of the piston 21 and controlled by a non-return valve 32 that enables passage of fluid only from the pressurized chamber C to the variable-volume chamber of the piston 21.

During normal operation of the known engine illustrated in FIG. 1, when the solenoid valve 24 excludes the communication of the pressurized-fluid chamber C with the exhaust channel 23, the oil present in said chamber transmits the movement of the pumping piston 16, imparted by the cam 14, to the piston 21 that controls opening of the valve 7. In the initial step of the movement of opening of the valve, the fluid coming from the chamber C reaches the variable-volume chamber of the piston 21 passing through the non-return valve 32 and further passages that set in communication the internal cavity of the piston 21, which has a tubular conformation, with the variable-volume chamber. After a first displacement of the piston 21, the nose 31 comes out of the opening 30 so that the fluid coming from the chamber C can pass directly into the variable-volume chamber through the opening 30, which is now free.

In the reverse movement of closing of the valve, as has already been said, during the final phase the nose 31 enters the opening 30 causing hydraulic braking of the valve so as to prevent any impact of the body of the valve against its seat, for example following upon an opening of the solenoid valve 24 that causes the immediate return of the valve 7 into the closing position.

As an alternative to the hydraulic-braking device illustrated in FIG. 1, the applicant has likewise already proposed (see European patent application No. EP 1 344 900 A2) an alternative solution in which the piston 21 for control of the intake engine valve is without end nose, and the non-return valve 32, instead of being made in the body of the piston 21, is made in a fixed part. In addition, in the wall of the bushing within which the piston 21 is slidably mounted, there give out one or more passages communicating directly with the pressure chamber C. Said passages are shaped and positioned in such a way that they are intercepted progressively by the piston 21 in the final step of closing of the engine valve in order to provide a restriction of the section of passage of the fluid, with consequent hydraulic-braking effect. In addition, in the solution proposed in the European patent application No. EP 1 344 900 A2, set between the piston 21 for control of the engine valve and the stem of the engine valve is an auxiliary hydraulic tappet.

The known system described above has been further perfected and developed in the course of the years by the present applicant. An improvement of particular interest has formed the subject of the European patent No. EP 1 555 398 B1, which regards an engine provided with a single camshaft, equipped with cams that actuate the engine intake valves via the variable-actuation system described above and cams that actuate the engine exhaust valves by means of a traditional mechanical transmission. Said document moreover illustrates further improved characteristics of the circuit for supply of the pressurized fluid to the pressurized chambers of the hydraulic system of actuation of the engine valves.

The present invention stems from a particularly simple and efficient version of the system for variable actuation of the valves in association with an internal-combustion engine of the type comprising at least two cylinders that have their respective intake strokes out of phase with respect to one another substantially by one complete revolution of the engine shaft.

Figure 2A:
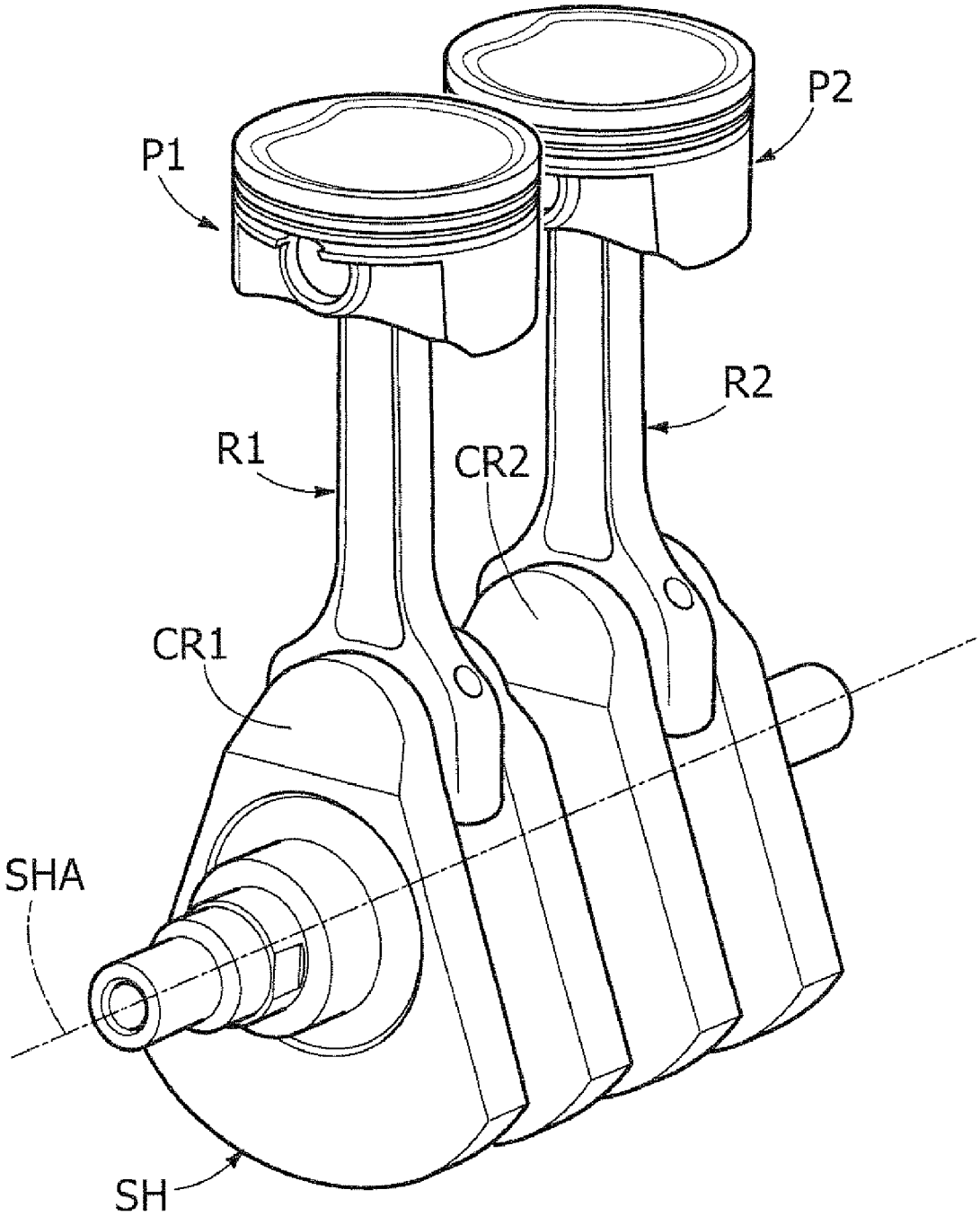
FIG. 2A is a schematic perspective view of the engine shaft and of the two pistons of a compact two-cylinder engine, with cranks out of phase by 360°, according to the present invention.

The typical case which regards particularly (but not exclusively) the present invention is that of a two-cylinder engine in which the cranks associated to the two pistons of the engine are out of phase with respect to one another by 0° (or, what amounts to the same thing, by 360°) of rotation of the engine shaft, according to what is schematically illustrated in FIG. 2A. In said figure, the reference SH designates as a whole the engine shaft of an internal-combustion engine with two cylinders in line associated to which are two pistons P1, P2. The shaft SH is carried in rotation about an axis SHA and has cranks CR1, CR2, out of phase with respect to one another by 0° of rotation of the engine shaft, connected to which are the connecting rods R1, R2 associated to the two pistons P1 and P2 slidably mounted in the two cylinders. As has been seen, the arrangement is such that the two pistons P1 and P2 reach simultaneously the top dead centre (TDC).

Figure 2B:
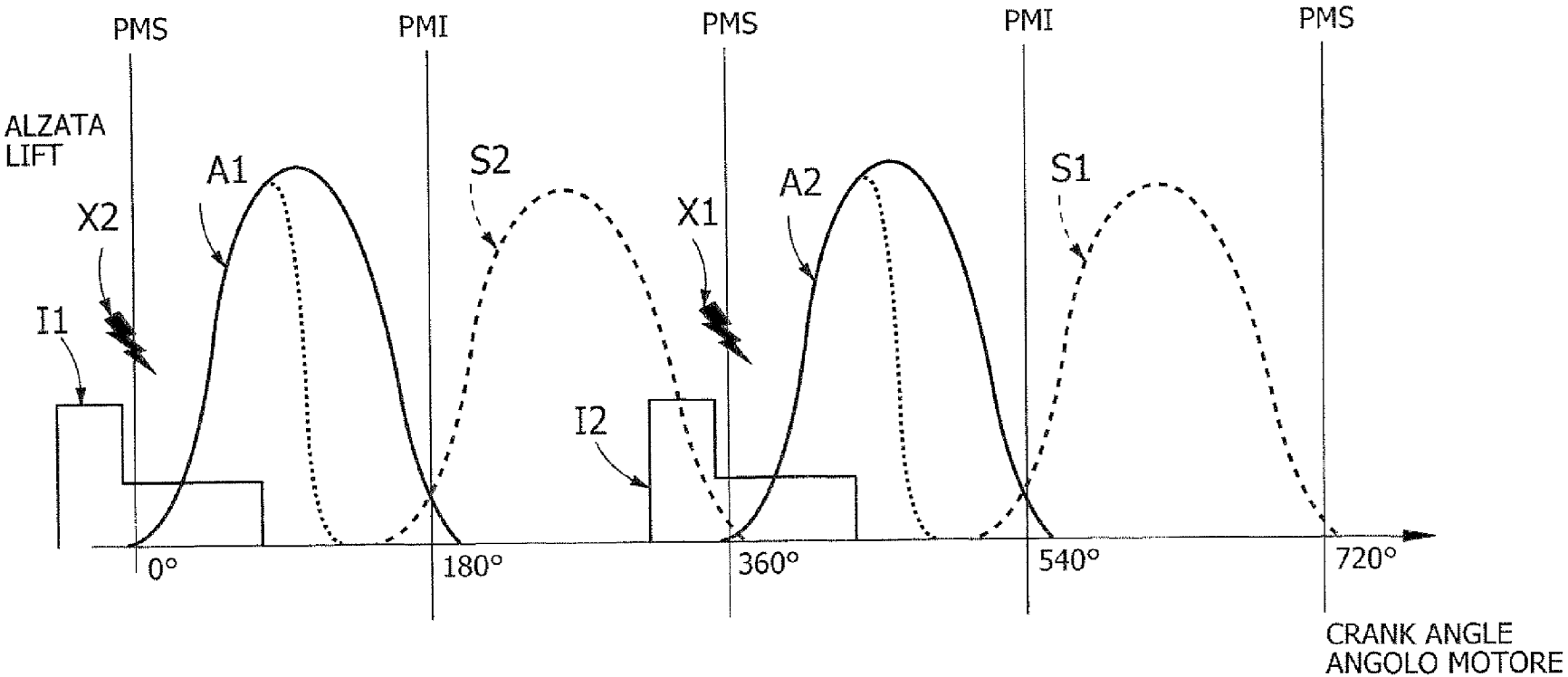
FIG. 2B illustrates a diagram that shows the lifts of the intake and exhaust valves of the engine represented in FIG. 2A.

FIG. 2B is a schematic illustration of the diagram of the lifts of the intake and exhaust valves associated to the two cylinders C1, C2, during rotation of the engine shaft. The two-cylinder engine described herein envisages two intake valves for each cylinder. In FIG. 2B, the lines A1 and A2 indicate, respectively, the displacement of the intake valves associated to the first cylinder and to the second cylinder during rotation of the engine shaft, whilst the lines S1 and S2 indicate the displacement of the exhaust valves associated to the first and second cylinders during rotation of the engine shaft. The spark symbols designated by X1 and X2 indicate the instants of ignition of the first and second cylinders. As may be seen, the intake strokes in the first and second cylinders are set at a distance apart from one another by one complete revolution of the engine shaft, a fact that is advantageously exploited in the case of the present invention in the way that will be described in detail in what follows.

Figure 3:
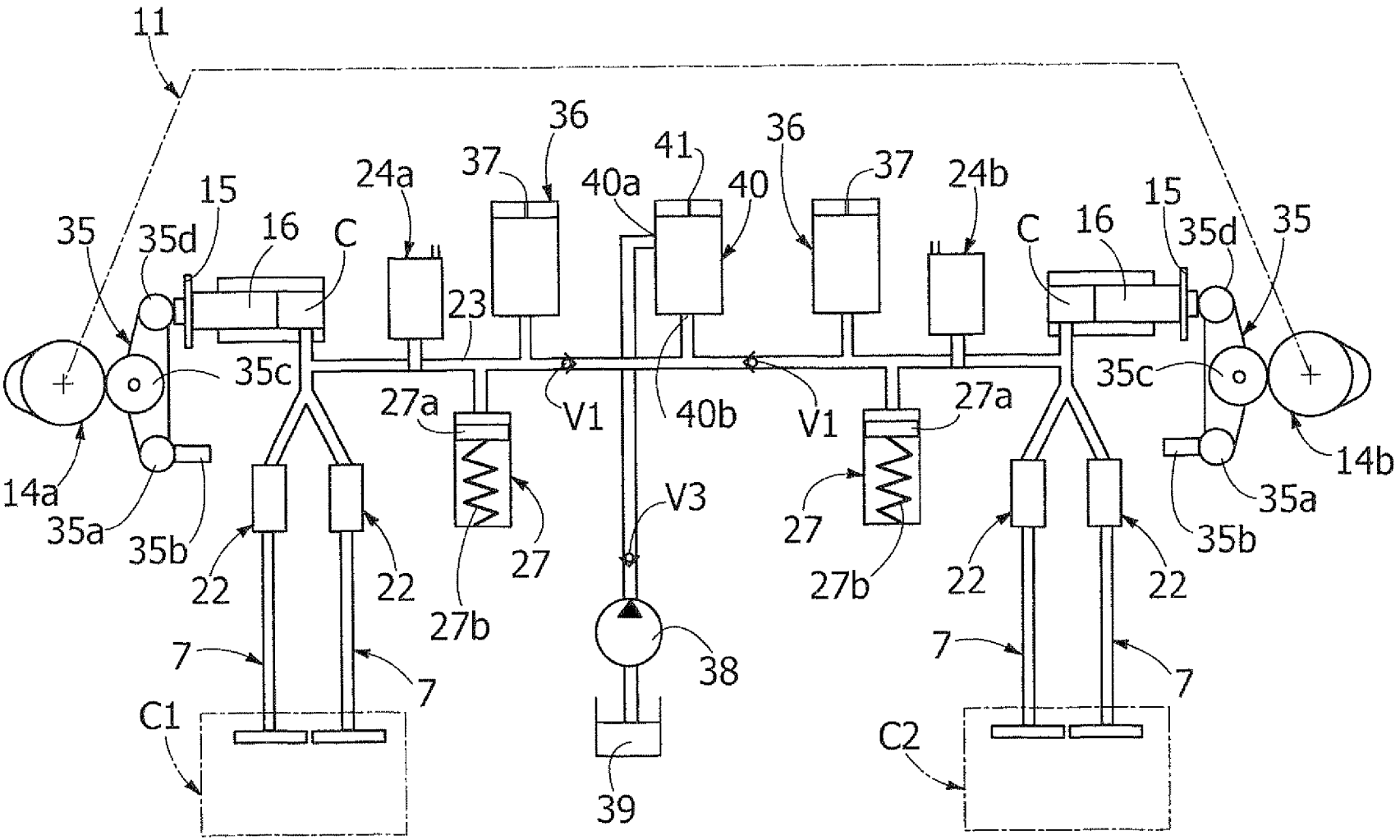
FIG. 3 is a schematic view of a system for variable actuation of the valves of an engine according to the known art.

FIG. 3 is a schematic illustration of the variable-actuation system already proposed by the present applicant in the prior patents, as appears if applied to a two-cylinder engine. According to the prior proposal made by the present applicant, the system envisages for each cylinder a pair of intake valves 7 (but the solution can be equally adopted in the case where each cylinder is provided with a single intake valve), each of which is actuated, by means of a hydraulic cylinder 22 of a type similar to what is described above with reference to FIG. 1, by pressurized oil that arrives from a pressurized chamber C associated to each cylinder. The fluid in the pressurized chamber C is pumped by the pumping piston 16 controlled by the cam. In the example illustrated, each tappet 15, 16 is actuated by a respective cam 14*a*, 14*b* of the camshaft 11 by means of a rocker 35, having an end 35*a* supported in an articulated way, by means of a suspension 35*b*, by the structure of the engine cylinder head. The rocker 35 carries in its intermediate area a wheel 35*c*, which co-operates with the cam 14 and has its end 35*d* opposite to the end 35*a* that co-operates with the tappet 15.

In FIG. 3, for convenience of representation, the cams 14*a*, 14*b* have been illustrated in the plane of the sheet. In actual fact, a single camshaft 11 is provided (illustrated schematically by a dashed-and-dotted line) mounted on which are both of the cams 14*a*, 14*b*.

According to the technique proposed by the present applicant in its previous patents and illustrated in FIG. 3, associated to each cylinder C1, C2 of the engine is a solenoid valve 24 that sets the pressurized chamber C of the respective cylinder in communication with an exhaust channel 23, connected to which is an accumulator of pressurized fluid 27 designed to receive inside it pressurized fluid with consequent displacement of a piston 27*a* against the action of a spring 27*b*, and a fluid tank 36 closed at the top by a lid having a hole 37 for communication with the atmosphere (more precisely with the compartment present underneath the lid of the cylinder head), for venting the air possibly present in the oil (see EP 1 243 761 B1 and EP 1 555 398 B1).

According to what is likewise illustrated in the last prior document cited herein, the pressurized-fluid chambers C are designed to receive pressurized oil from the lubrication circuit of the engine, via a supply pump 38, which feeds pressurized oil from a tank 39 to the channel 23, which is connected to the pressurized chambers C via a main fluid tank 40 closed at the top by a lid provided with an opening for venting to the atmosphere 41. The tank 40 also performs the function of siphon in so far as it receives the fluid from the pump 38 through an inlet 40*a* located in its top area and sends fluid to the channel 23 through an outlet 40*b* situated in its bottom area so as to enable bleeding of the air present in the oil. Interposed in the communication of the outlet 40*b* of the main fluid tank 40 with the two channels 23 that lead to the pressurized chambers C are non-return valves V1, which enable the passage of fluid only in the direction of the pressurized chambers C.

In the embodiments proposed previously by the present applicant, the solenoid valves 24 are normally open. In said condition, the rotation of the camshaft 11 does not cause actuation of the valves 7 in so far as the latter are withheld in their closed position by the respective return springs, whilst the pressurized oil present in the chambers C is pushed by the pumping pistons 16 into the accumulators 27 given that it cannot pass beyond the non-return valves V1. When the solenoid valves 24 are actuated by supply of their solenoid, the communication between the pressurized chambers C and the exhaust channels 23 is interrupted so that the movement of the pumping pistons 16 caused by the rotation of the camshaft 11 determines the movement of the intake valves 7 by means of the hydraulic cylinders 22. As is extensively described and illustrated in a wide range of patents filed in the name of the present applicant, control of the solenoid valves is performed so as to vary as required both the instants of opening and of closing of each intake valve and the degree of the lift itself as a function of the operating conditions of the engine in order to obtain the best results, in every operating condition, from the standpoint of the maximum efficiency and/or of the minimum consumption of fuel and/or of the minimum emission of noxious exhaust gases.

Figure 4:
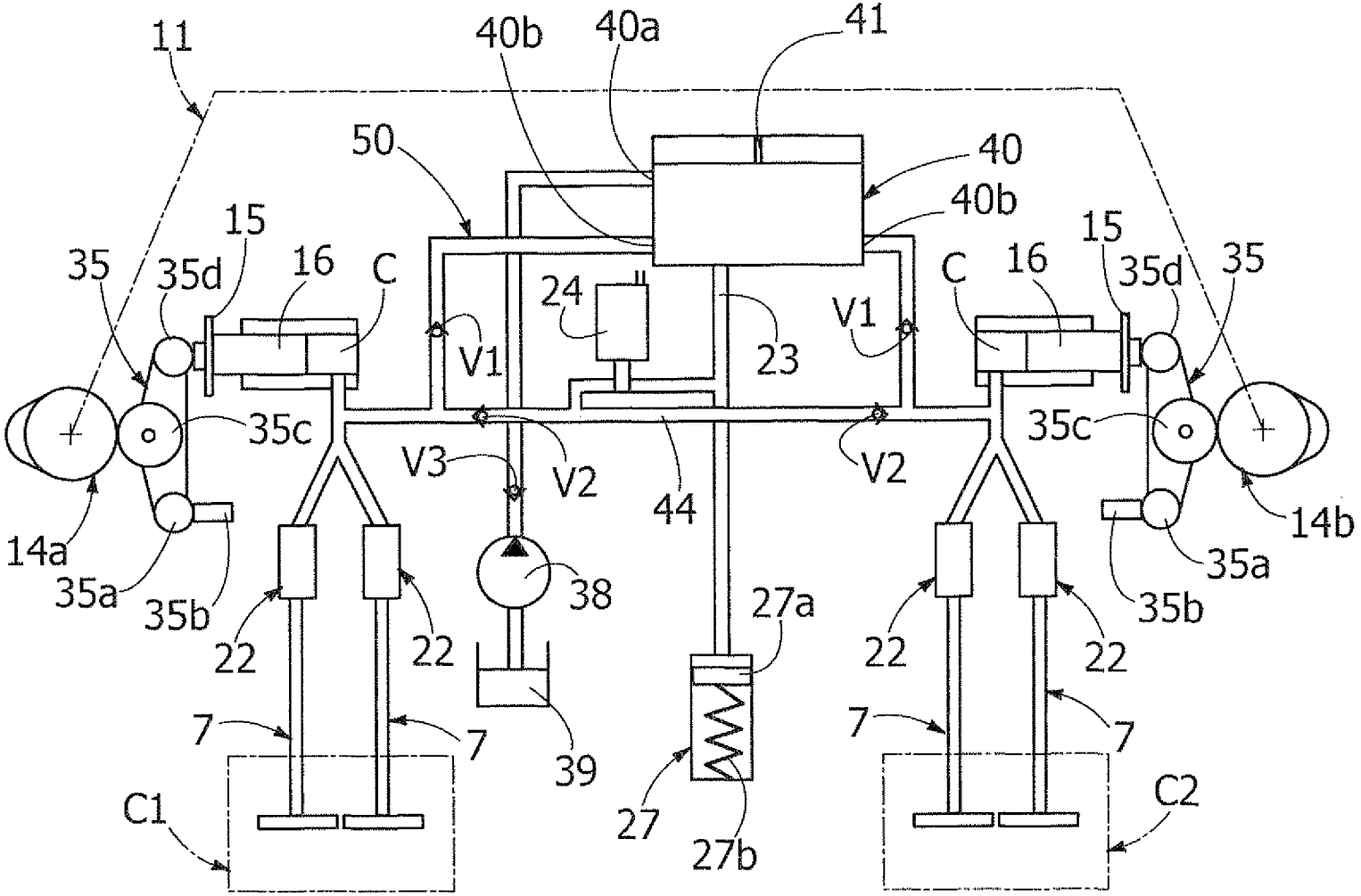
FIG. 4 is a schematic view of a system for variable actuation of the valves of an engine according to the invention.

FIG. 4 illustrates the simplified system for variable actuation of the valves, which is proposed in compliance with the present invention in association with a two-cylinder engine of the type illustrated in FIG. 2A. By exploiting the fact that the intake strokes in the two engine cylinders are set at a distance from one another by one complete revolution of the engine shaft, the present applicant has been able to conceive a system in which a single solenoid valve is used for controlling opening and closing of the intake valves of both of the cylinders.

In FIG. 4, the parts in common with the ones of FIG. 3 are designated by the same references. Also in FIG. 4, for convenience of representation, the camshaft 11 that carries both of the cams 14*a*, 14*b* is illustrated schematically.

The main difference of the system of FIG. 4 with respect to that of FIG. 3 lies in the fact that in said system the communication of the pressurized chambers C associated to the intake valves of the two engine cylinders with the exhaust channel 23 is controlled by a single solenoid valve 24, said exhaust channel 23 being common for the two pressurized chambers C. In the case of the embodiment illustrated in FIG. 4, a main channel is provided for supply of the pressurized oil, as in the case of the known solution, which receives the oil from the pump 38 and feeds it into the top area of a main tank 40 provided with a top venting hole 41 functioning as siphon, in a way similar to what is illustrated above. In this case, the pressurized oil supplied by the pump 38 can be sent from the tank 40 to the pressurized chambers C via two different outlets 40*b* made in the bottom area of the tank 40 (to obtain the siphon function), and via two channels interposed in which are the first non-return valves V1, having a function similar to the valves V1 of FIG. 3, i.e., such as to enable passage of fluid only in the direction of the chambers C. At the same time, according to the embodiments illustrated in FIG. 4, the two pressurized chambers C communicate also directly with one another through a by-pass channel 44 via two non-return valves 72, which enable the passage of fluid only from the pressurized chambers C to the by-pass channel 44. The single common solenoid valve 24 controls the communication between said by-pass channel 44 and a common exhaust channel 23, which is connected to the bottom of the main fluid tank 40 as well as to a single fluid accumulator 27.

The solenoid valve 24 is normally open but is designed to receive a current pulse I1, the form of which can be, for example, the one illustrated in FIG. 2B, corresponding to the intake stroke of the first cylinder, and a current pulse I2 corresponding of to the intake stroke of the second cylinder. When the solenoid valve closes, the cams of the camshaft pre-arranged for actuating, in said phase, opening of the intake valves of one of the two cylinders, bring about said opening, according to times and strokes that depend upon the time of opening of the solenoid valve, whilst the intake valves associated to the other cylinder remain closed, since in the same phase, the respective actuation cam is in contact with the respective rocker with its part having constant radius.

The system would likewise enable a normally closed solenoid valve given the presence of the non-return valves V1 that enable supply of the chambers C (topping-up of any oil that has leaked).

The system thus enables considerable simplification of the structure and number of components of the assembly for actuation of the valves, leaving, however, unaltered the advantages of the system in terms of overall flexibility as regards to the possibility of varying the time and stroke of opening of the intake valves of each cylinder in the various operating conditions of the engine.

In particular, as has already been mentioned, the system enables reduction (halving in the specific case described herein) of the number of the solenoid valves (a single solenoid valve instead of two), reduction in the number of the accumulators (a single accumulator instead of two), and reduction in the number of tanks. The arrangement of the system according to the invention guarantees also a better filling in cold conditions of the pressurized chambers C thanks to the presence of the non-return valves that enable a larger area of passage as compared to that of the solenoid valves used in the known solutions. The reduction in the number of elements also leads to a considerable reduction in the overall dimensions of the system for variable actuation of the valves, and a reduction in the number of controls that must be prearranged in the electronic control unit 25. Finally, also the wiring is simplified, thanks to the provision of a single solenoid valve. All the aforesaid advantages are particularly important in the case of a compact engine for a motor vehicle of small dimensions.

Of course, without prejudice to the principle of the invention, the details of construction and the embodiments may vary widely with respect to what is described and illustrated herein purely by way of example, without thereby departing from the scope of the present invention.

For example, not excluded is the possibility of adopting the system described herein also in engines having a number of cylinders equal to or greater than two, in which the intake valves of pairs of cylinders are controlled by a single solenoid valve for each pair of cylinders.

What is claimed is:

1. A multi-cylinder internal-combustion engine comprising:

at least one intake valve and at least one exhaust valve for each cylinder, each provided with respective elastic return means that push the valve towards a closed position, for controlling respective intake pipes and exhaust pipes;

at least one camshaft for actuating the intake valves and the exhaust valves of the engine cylinders by means of respective tappets, wherein each intake valve is controlled by the respective tappet, against the action of the aforesaid elastic return means, by interposition of hydraulic means including a pressurized-fluid chamber;

said pressurized-fluid chamber being designed to be connected by means of a solenoid valve to an exhaust channel in order to uncouple the intake valve from the respective tappet and cause fast closing of the valve as a result of the respective elastic return means; and electronic control means for controlling each solenoid valve in such a way as to vary the time and the stroke of opening of the respective intake valve as a function of one or more operating parameters of the engine, wherein said engine has at least two different cylinders that have their respective intake strokes out of phase with respect to one another substantially by one complete revolution of the engine shaft;

wherein communication with the exhaust channel of the pressurized-fluid chambers associated to the intake valves of said two different cylinders is controlled by a single common solenoid valve, wherein a main channel for supply of pressurized fluid is provided, communicating with the pressurized chambers associated to the intake valves of the two different cylinders of the engine via respective first non-return valves that enable the passage of fluid only in the direction of the pressurized-fluid chambers, wherein the pressurized chambers associated to the intake valves of said two different cylinders of the engine are also directly connected to one another by a by-pass channel via two respective second non-return valves that enable the passage of fluid only from each of the two pressurized chambers towards said by-pass channel; and wherein said by-pass channel is designed to be set in communication via the aforesaid single common solenoid valve with an exhaust channel common for the two pressurized chambers, wherein associated to the two pressurized chambers associated to the intake valves of the aforesaid two different cylinders of the engine is a single common fluid accumulator that is in communication with said common exhaust channel, wherein interposed in the main channel for supply of pressurized fluid is at least one fluid tank vented at the top to the atmosphere, having an inlet at its top for receiving the pressurized fluid, and an outlet on its bottom connected to the pressurized chambers via said first non-return valves, and wherein said tank has a further outlet on its bottom communicating with said common exhaust channel.

* * * * *